US005529205A

United States Patent [19]

Corney et al.

[11] Patent Number: 5,529,205

[45] Date of Patent: Jun. 25, 1996

[54] HINGE ASSEMBLY FOR A CONTAINER

[75] Inventors: Richard E. Corney, Uniontown; John F. Travers, North Royalton, both of Ohio

[73] Assignee: Carex Inc., Newark, N.J.

[21] Appl. No.: 355,477

[22] Filed: Dec. 14, 1994

[51] Int. Cl.[6] ..... B65D 43/24

[52] U.S. Cl. ..... 220/342; 220/335; 220/338

[58] Field of Search ..... 220/335, 338, 220/342

[56] References Cited

U.S. PATENT DOCUMENTS

| | | | |
|---|---|---|---|
| 479,936 | 8/1892 | Foster . | |
| 1,709,182 | 4/1929 | McKnight et al. . | |
| 2,342,477 | 2/1944 | Magnenat | 220/338 |
| 2,732,581 | 1/1956 | Heck | 220/338 |
| 2,797,840 | 7/1957 | Gibbs | 220/31 |
| 3,023,923 | 3/1962 | Geib et al. | 220/31 |
| 3,126,120 | 3/1964 | Crate | 220/31 |
| 3,272,379 | 9/1966 | Driza et al. | 220/31 |
| 4,193,164 | 3/1980 | Okayama | 16/141 |
| 4,349,120 | 9/1982 | DiNardo | 220/337 |
| 4,354,543 | 10/1982 | Bogner | 220/335 X |
| 4,372,007 | 2/1983 | Lee | 16/260 |
| 4,615,464 | 10/1986 | Byrns | 220/469 |
| 4,663,803 | 5/1987 | Gora | 16/266 |
| 4,694,533 | 9/1987 | Doyen | 16/257 |
| 4,789,078 | 12/1988 | Miller et al. | 220/335 |
| 4,832,193 | 5/1989 | Kime | 206/372 |
| 4,942,271 | 7/1990 | Corsi et al. | 220/338 X |
| 4,967,924 | 11/1990 | Murofushi et al. | 220/3.8 |
| 5,048,715 | 9/1991 | Wolff | 220/335 |
| 5,071,024 | 12/1991 | Delmerico et al. | 220/335 |
| 5,078,297 | 1/1992 | Howard et al. | 220/533 |
| 5,150,806 | 9/1992 | Glomski | 220/331 |

FOREIGN PATENT DOCUMENTS

| | | | |
|---|---|---|---|
| 808023 | 1/1959 | United Kingdom . | |
| 2071754 | 9/1981 | United Kingdom | E05D 1/06 |
| 2128245 | 4/1984 | United Kingdom | E05D 7/10 |

*Primary Examiner*—Joseph M. Moy

*Attorney, Agent, or Firm*—Renner, Kenner, Greive, Bobak, Taylor & Weber

[57] ABSTRACT

A container (10) includes a cover (12) pivotally attached to a base portion (11) by a hinge assembly (24). The hinge assembly (24) includes a pin (28) carried by the base portion (11) and received through an opening (33) in a knuckle (32) carried by the cover (12). The knuckle (32) is rotated on the pin (28) such that when the cover (12) is on the base portion (11), the opening (33) faces generally downwardly, and when the cover (12) is rotated approximately 180 degrees, the opening (33) faces generally upwardly. The hinge assembly (24) also includes spaced lugs (34) carried by the knuckle (32) and spaced resilient stop members (30) carried by the base portion (11). The space between the stop members (30) is less than the space between the lugs (34) such that when the cover (12) is rotated a predetermined distance, the stop members (30) engage the lugs (34), but if the cover (12) is rotated further than the predetermined distance, the stop members (30) flex to release the lugs (34) so that the lugs (34) can pass between the stop members (30).

16 Claims, 4 Drawing Sheets

HINGE ASSEMBLY FOR A CONTAINER

TECHNICAL FIELD

This invention relates to a hinge for pivotally connecting a cover to a container. More particularly, this invention relates to a hinge assembly which permits the cover to be readily, totally removed from the container, which permits the cover to be fixedly positioned in a predetermined open condition, and which will not be damaged if it is forced past the predetermined open position.

BACKGROUND ART

A common way to attach a cover to a container, such as all-purpose plastic storage containers, toolboxes or the like, is to provide a hinge assembly on one edge of the cover and the container and some type of latch mechanism on the opposite edge of the cover and the container. Usually the hinge connection between the cover and the base container portion is designed to be permanent in nature; that is, the cover cannot be totally removed from the container as may be desired under several circumstances.

In addition, many hinge designs permit the cover to be freely rotated from its normal horizontal position on the container base to a possible total of 270 degrees to a position parallel and adjacent to the side of the container. Because space considerations do not always make such movement practical, to avoid such movement, oftentimes hinges are designed so that the cover will be held generally vertically after pivoting approximately 90 degrees. Such allows the container to be more readily usable in a confined space and without damage to the cover or an adjacent wall, for example, that it might contact. However, if such covers are forced or accidentally bumped past their 90 degree permissible rotation, most such plastic hinges will break, thereby rendering the cover no longer usable with the container.

DISCLOSURE OF THE INVENTION

It is thus an object of the present invention to provide a container with a versatile hinge assembly for attaching a cover to the base portion of the container.

It is another object of the present invention to provide a container, as above, in which the hinge assembly can be readily disassembled such that the cover can be totally removed from the base portion of the container.

It is a further object of the present invention to provide a container, as above, with a hinge assembly which will hold the cover erect after approximately 90 degrees rotation from its horizontal position on the base portion.

It is an additional object of the present invention to provide a container, as above, in which the cover can be rotated or moved past its 90 degree erect position without damage to the hinge assembly.

These and other objects of the present invention, as well as the advantages thereof over existing prior art forms, which will become apparent from the description to follow, are accomplished by the improvements hereinafter described and claimed.

In general, a container having a hinge assembly made in accordance with the concepts of the present invention includes a base portion and a cover pivotally connected to the base portion by the hinge assembly. The hinge assembly includes a knuckle which receives a pin therein and which is rotatable relative to the pin. Lugs are carried by the knuckle to engage a stop member when the cover is rotated a predetermined distance to hold the cover at that position. The stop member is resilient so that, if the cover is rotated past the predetermined distance, the stop member will flex to release the lugs.

In accordance with another aspect of the present invention, the knuckle has an opening therein through which the pin passes to be positioned within the knuckle. The opening is generally downwardly positioned when the cover is closed on the container so that the pin can be readily positioned into or taken out of the knuckle, and the opening is generally upwardly positioned when the cover is rotated approximately 180 degrees so that the pin may fall out of the knuckle to disassemble the hinge assembly before any damage can be done thereto.

A preferred exemplary hinge assembly for a container incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
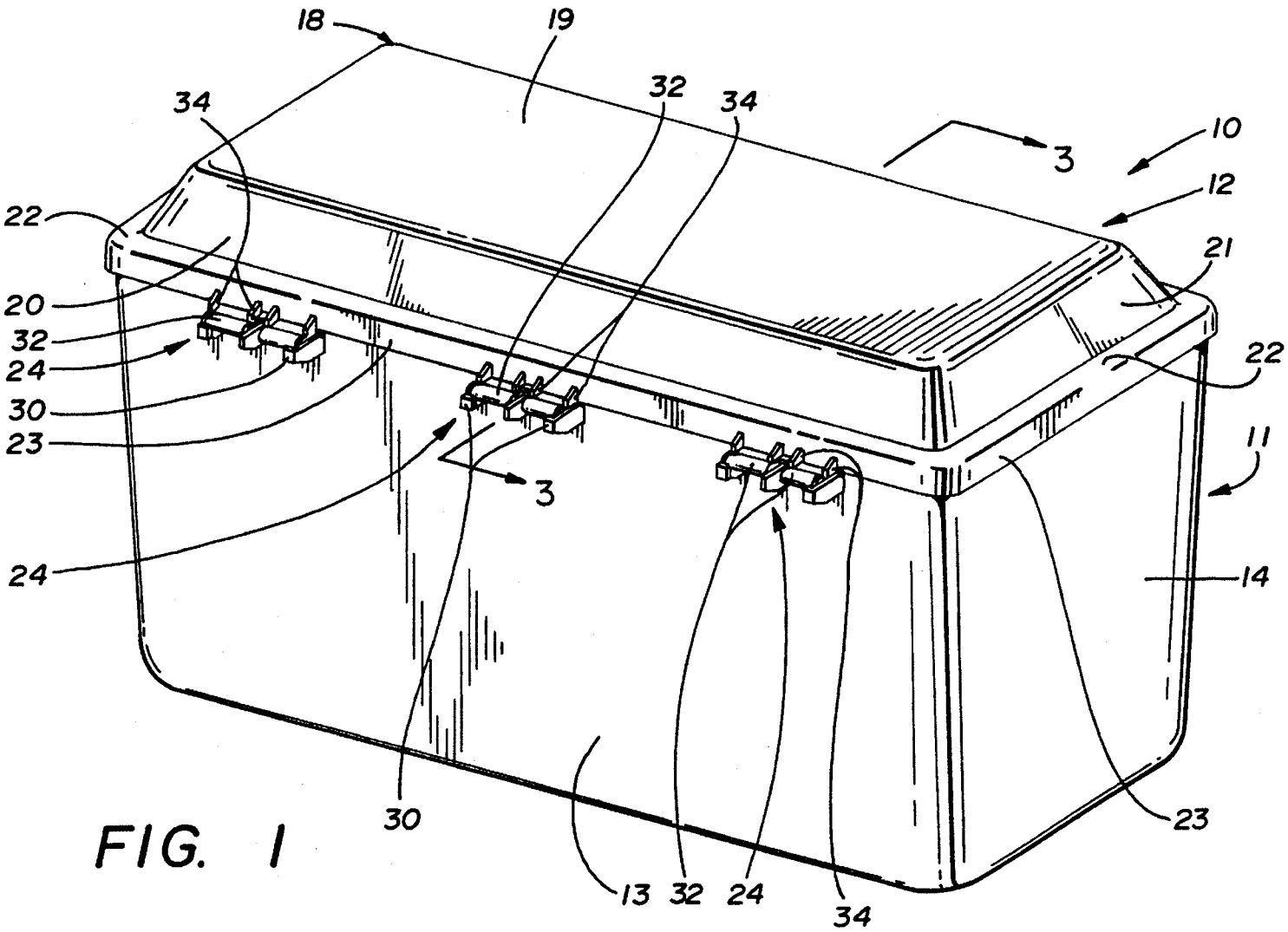
FIG. 1 is a perspective view of a container having a hinge assembly made in accordance with the concepts of the present invention.

A container having a hinge assembly made in accordance with the present invention is indicated generally by the numeral 10 in FIG. 1. Container 10 can be made of any suitable plastic material, such as polypropylene, and can take on any configuration. As such, container 10 is shown as having a rather commonly configured base portion, generally indicated by the numeral 11, and a commonly configured cover generally indicated by the numeral 12.

Figure 4:
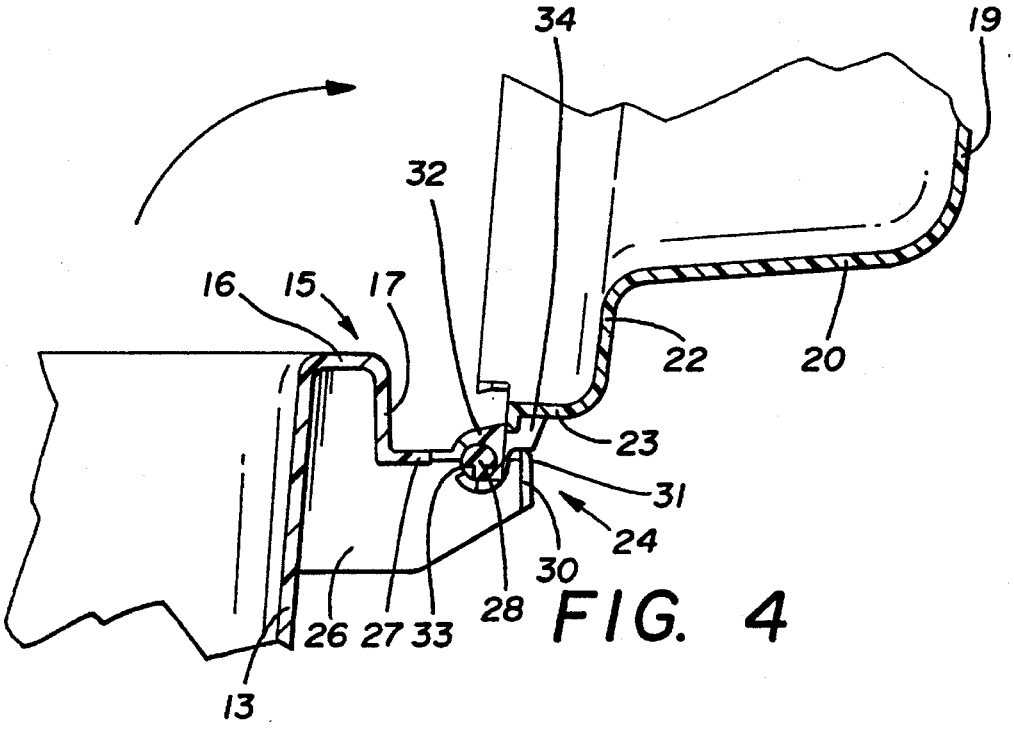
FIG. 4 is a partial sectional view similar to a portion of FIG. 3 and showing the cover held at an upright position relative to the base portion.
Figure 5:
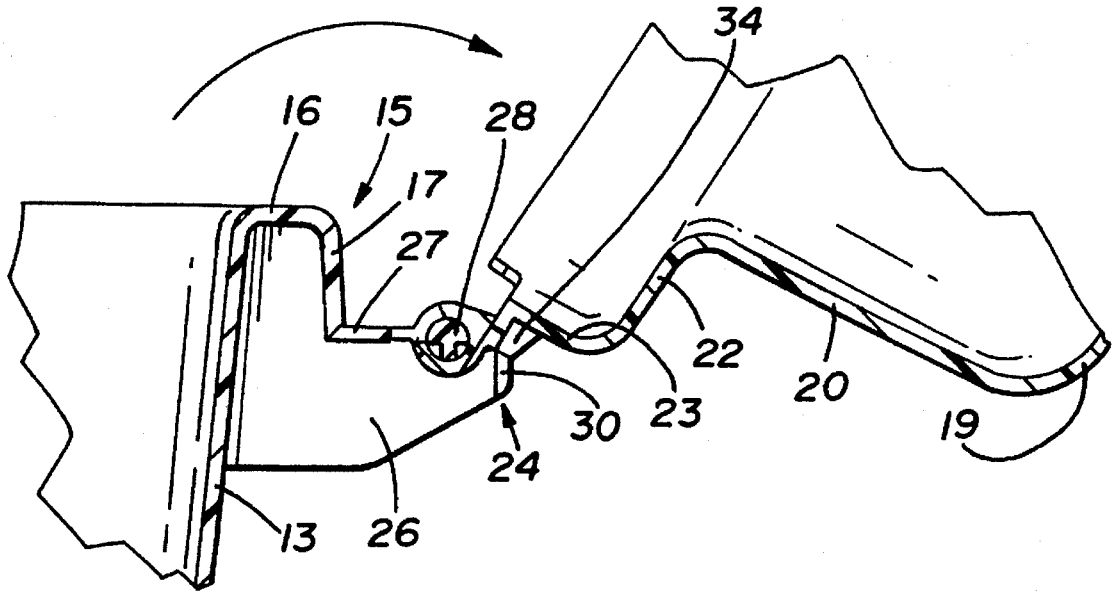
FIG. 5 is a partial sectional view similar to a portion of FIG. 3 and showing the cover being pivoted beyond the position of FIG. 4.
Figure 6:
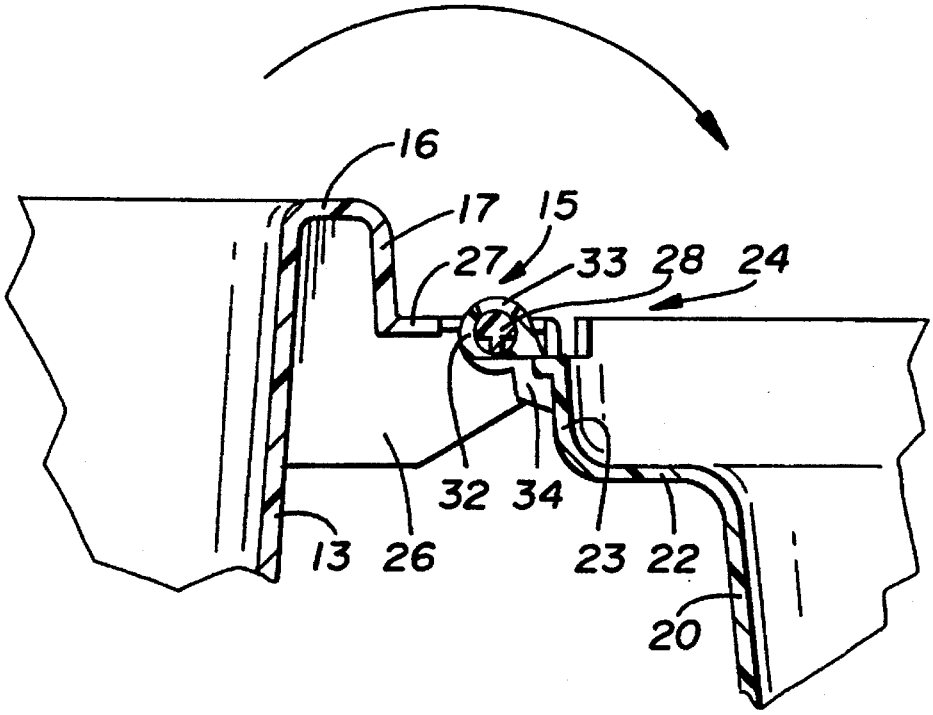
FIG. 6 is a partial sectional view similar to a portion of FIG. 3 and showing the cover having been pivoted beyond the position shown in FIG. 5.

Base portion 11 therefore includes a bottom surface (not shown), opposed side walls 13 extending upwardly from the bottom surface, and opposed end walls 14 joining side walls 13 and extending upwardly from the bottom surface. Together, side walls 13 and end walls 14 form an open top having an upper rim generally indicated by the numeral 15, as best seen in FIGS. 4–6. Upper rim 15 of base portion 11 includes a continuous upper ledge 16 extending generally horizontally outwardly from side walls 13 and end walls 14. A downturned flange 17 is formed of the outer end of ledge 16 and is generally parallel to side walls 13 and end walls 14.

Cover 12 includes a domed top generally indicated by the numeral 18. Top 18 has a horizontal upper surface 19 and downturned side walls 20 and end walls 21. A generally horizontal lip 22 is formed at the bottom of side walls 20 and end walls 21 and is adapted to rest on ledge 16 of base portion 11 when cover 12 is closed on base portion 11. A downturned skirt 23 is formed at the outer end of lip 22 and is adapted to generally surround flange 17 of base portion 11 when cover 12 is closed on base portion 11.

Figure 2:
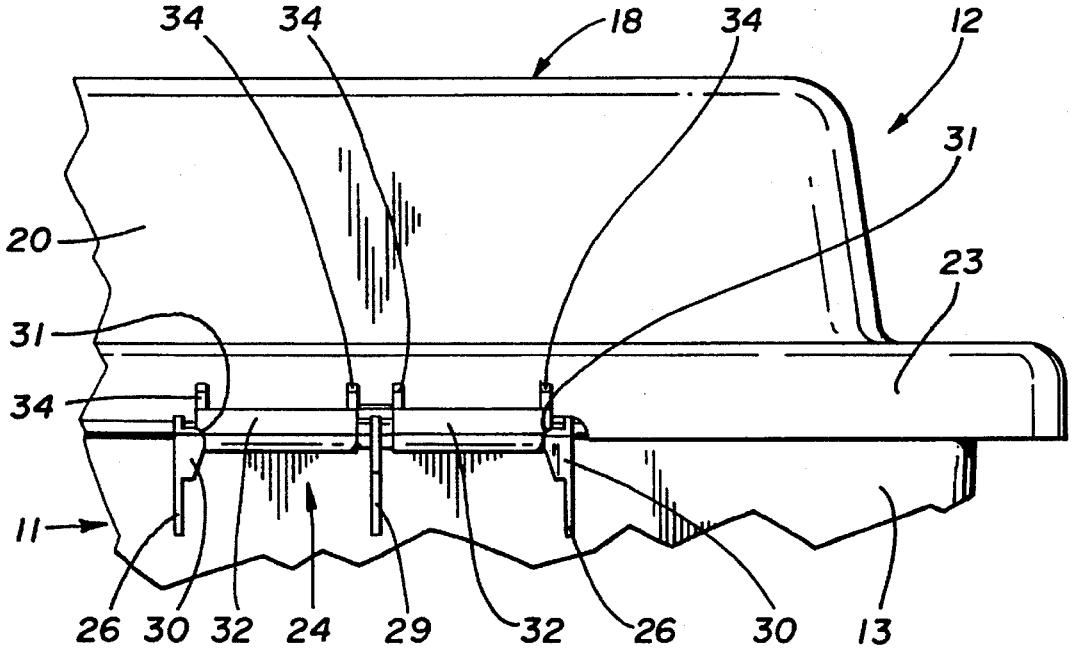
FIG. 2 is a fragmented rear elevational view of the container of FIG. 1.
Figure 3:
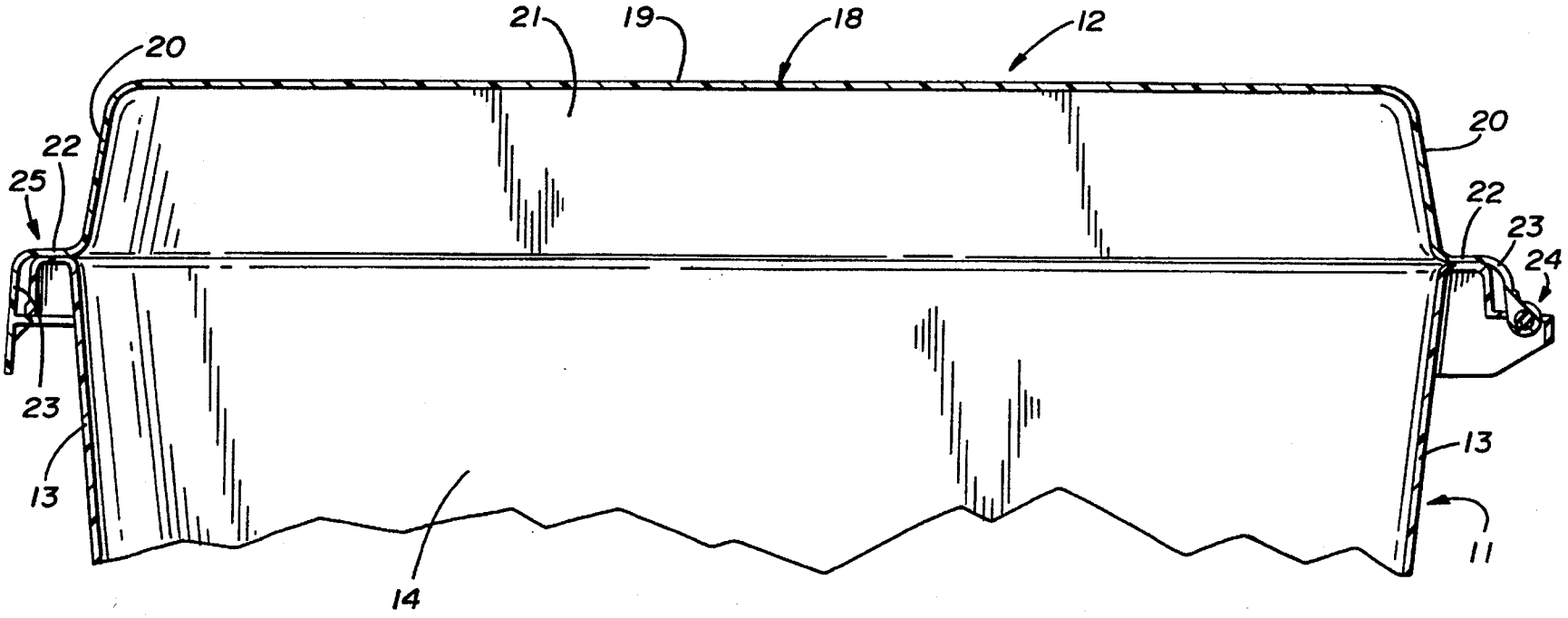
FIG. 3 is a sectional view taken substantially along line 3—3 of FIG. 1.

Cover skirt 23 is pivotally attached to a side wall 13 of base portion 11 by a hinge assembly made in accordance with the present invention and generally indicated by the numeral 24. A conventional latch assembly 25 (FIG. 3) may be provided on the side wall 13 and skirt 23 opposed to the side wall 13 and skirt 23 carrying hinge assembly 24 to maintain cover 12 on base portion 11 as shown in FIGS. 1–3. Latch assembly 25 can take on any form and, for example, could even be a lock and key arrangement.

The present invention relates to the configuration of hinge assembly 24 which is shown in FIG. 1 as being in the form of three separate hinge assembly 24 units. It should be understood, however, that hinge assembly 24 could be one continuous unit or could be any number of separate units, three being shown in FIG. 1 as typical. It should also be understood that, while one hinge assembly 24 unit will be hereinafter described, if more than one unit is provided, they are intended to be identical.

Each unit of hinge assembly 24 includes a pair of outer gusset plates 26 which are carried by base portion 11 and supported by upper rim 15. If desired, additional lateral support for gussets 26 may be provided by forming a horizontally-extending member 27 at the bottom of flange 17 of rim 15, member 27 extending between gussets 26. Also extending between and carried by gussets 26 is a hinge pin 28 which may be generally centrally supported by another gusset plate or rib 29. As best shown in FIG. 2, each gusset 26 also carries a resilient stop member 30 having an upper bevelled surface 31. Stop members 30 are positioned on gussets 26 so as to be opposed to or facing each other. As such, opposed bevelled surfaces 31 are closest to each other at the lowest point thereof.

Each hinge assembly 24 also includes hinge knuckles 32 which are carried by and extend outwardly from cover skirt 23. While one continuous knuckle 32 for each hinge assembly unit would suffice, two knuckles 32 for each hinge assembly unit are shown, one knuckle 32 being positioned on each side of support rib 29. Knuckles 32 have an opening 33 formed therein so that, by positioning the knuckles 32 with their openings 33 adjacent to pin 28 and by pressing on the knuckles 32 or cover 12, openings 33 will expand slightly to snap knuckles 32 onto pin 28. As shown in FIG. 3, when cover 12 is positioned horizontally on base portion 11, knuckle openings 33 are facing downwardly, and with latch 25 open, cover 12 may be totally removed from base portion 11 by merely pulling up on knuckles 32.

Each knuckle 32 can be provided with lugs 34 extending generally radially outwardly therefrom at both longitudinal ends thereof as shown, for example, in FIG. 2. Lugs 34 are generally formed at a circumferential position on knuckles 32 diametrically opposed to knuckle opening 33. Thus, as shown in FIG. 2, when knuckle opening 33 is in the lowermost position, facing downwardly, lugs 34 are extending generally vertically upwardly.

Rotation of cover 12 with respect to base portion 11, for example, from the FIGS. 2 and 3 position to the FIG. 4 position, causes knuckles 32 to rotate on pin 28 until lugs 34 come into contact with and rest upon surface 31 of stop members 30 as shown in FIG. 4. As such, cover 12 is maintained in a generally vertical position, actually slightly past vertical, and container 10 is open. It should be noted that only the outer two lugs 34 shown in FIG. 2 engage stop members 30, with the inner lugs 34 adjacent to rib 29 playing no part in holding cover 12 in the FIG. 4 position. But each knuckle 32 is preferably provided with two lugs 34, even though only one is ever needed, for convenience of interchangeability, so that only one style of knuckle 32 has to be manufactured—as opposed to having to manufacture "right hand" and "left hand" knuckles.

When dealing with prior art hinge assemblies, when the cover is oriented relative to the base portion as shown in FIG. 4, accidental or intentional movement of the cover past the predetermined FIG. 4 position, for example, toward the FIG. 5 position, would most likely break and otherwise damage the hinge assembly. However, such will not happen with hinge assembly 24 of the present invention. Rather, when cover 12 is moved from the FIG. 4 toward the FIG. 5 position, lugs 34 will press down on stop members 30, flexing or expanding them away from each other, as viewed in the FIG. 2 position, as lugs 34 slide down bevelled surface 31. Eventually, lugs 34 will disengage stop members 30 which will flex back toward each other and cover 12 can move, for example, to the FIG. 5 or even the FIG. 6 position, depending on whether cover 12 has been stopped by the user or an adjacent wall.

While the dimensional relationships and spacing of lugs 34 and stop members 30 may vary slightly depending on, for example, the flexing characteristics of the material being employed, for the preferred polypropylene container 10 disclosed herein, it has been found that the spacing between stop members 30 should be in the range of fifteen to twenty thousandths of an inch less than the spacing between lugs 34. That is, the distance between the two lugs 34 which engage stop members 30 as viewed in FIG. 2 is fifteen to twenty thousandths of an inch greater than the distance between the bottom of bevelled surfaces 31 of stop members 30 as viewed in FIG. 2. As such, lugs 34 will normally rest on stop members 30 as shown in FIG. 4, but if forced downwardly, stop members 30 will flex outwardly until lugs 34 pass therebetween.

Again, when dealing with prior art hinge assemblies, when reaching the FIG. 6 position, if damage had not already occurred, usually damage or additional damage to the hinge assembly would occur due to the fact that most all of the weight of the hanging cover is now being carried by the hinge assembly. However, in accordance with hinge assembly 24 of the present invention, if and when cover 12 arrives at the position showing in FIG. 6, knuckle opening 33 is facing upwardly at the top of hinge pin 28 and, if the weight of cover 12 is sufficient, rather than cause damage to hinge assembly 24, cover 12 will merely fall off as knuckle 32 expands, at opening 33, to disengage pin 32.

It should thus be evident that a hinge assembly constructed in accordance with the present invention, as described herein, accomplishes the objectives of the present invention and otherwise substantially improves the container art.

We claim:

1. A container comprising a base portion having an open top, a cover for closing the open top, and a hinge assembly for pivotally connecting said cover to said base portion; said hinge assembly including a knuckle, a pin received within said knuckle, said knuckle being rotatable relative to said pin, a stop member, and lug means carried by said knuckle to engage said stop member when said cover is rotated a predetermined distance less than 180° so that the cover is maintained at the predetermined distance, said stop member being resilient so that if said cover is rotated more than the predetermined distance, said stop member will flex to release said lug means so that said cover can freely rotate with respect to said base portion up to approximately 180° from the closed position.

2. A container comprising a base portion having an open top, a cover for closing the open top, and a hinge assembly for pivotally connecting said cover to said base portion; said hinge assembly including a knuckle having an opening therein, a pin received through, said opening, said knuckle being rotatable relative to said pin such that said opening faces generally downwardly when said cover is closed on said base container and faces generally upwardly when said cover is rotated approximately 180 degrees, a stop member, and lug means carried by said knuckle to engage said stop member when said cover is rotated a predetermined distance, said stop member being resilient so that if said cover is rotated more than the predetermined distance, said stop member will flex to release said lug means.

3. A container according to claim 1 wherein there are two opposed stop members engaged by said lug means.

4. A container according to claim 3 wherein each stop member includes a bevelled surface engaged by said lug means.

5. A container according to claim 1 wherein said knuckle is carried by said cover and said pin and said stop member are carried by said base portion.

6. A container according to claim 4, said hinge assembly further including spaced plate means carried by said base portion for carrying said pin.

7. A container according to claim 6 wherein there are two stop members, one said stop member being carried by each said plate means, and said lug means includes two spaced lugs, each said lug being adapted to engage a said stop member.

8. A container according to claim 1 wherein said hinge assembly further includes a second stop member spaced from said first stop member, and said lug means includes spaced lugs.

9. A container according to claim 8 wherein the space between said stop members is less than the space between said lugs.

10. A container comprising a base portion having an open top, a cover for closing the open top, and a hinge assembly for pivotally connecting said cover to said base portion; said hinge assembly including a knuckle carried by said cover and having an opening therein, a pin carried by said base portion and received through said opening so as to be positioned within said knuckle, said knuckle being rotated relative to said pin, said opening facing generally downwardly when said cover is closed on said base portion and facing generally upwardly when said cover is rotated approximately 180 degrees, lug members carried by said knuckle, and resilient stop means carried by said base portion to engage said lug members when said cover is rotated a predetermined distance, said stop means flexing to release said lug members if said cover is rotated beyond the predetermined distance.

11. A container comprising a base portion having an open top, a cover for closing the open top, and a hinge assembly for pivotally connecting said cover to said base portion; said hinge assembly including a knuckle having an opening therein, a pin received through said opening so that said pin is positioned within said knuckle, said knuckle being rotatable relative to said pin, spaced stop members, and spaced lugs carried by said knuckle, each said lug engaging a said stop member when said cover is rotated a predetermined distance, said stop members being flexible so that, if said cover is rotated more than the predetermined distance, said stop members will flex to permit the passage of said lugs therebetween, said opening in said knuckle facing generally downwardly when said cover is closed on said base portion and facing generally upwardly when said cover is rotated approximately 180 degrees.

12. A container according to claim 11 wherein the space between said stop members is less than the space between said lugs.

13. A container according to claim 11 wherein each stop member includes a bevelled surface engaged by a said lug member.

14. A container according to claim 11 wherein said knuckle is carried by said cover and said pin and said stop members are carried by said base portion.

15. A container according to claim 14, said hinge assembly further including spaced plates carried by said base portion, each plate carrying a said stop member, said pin extending between said plates.

16. A container according to claim 15, said hinge assembly further including a rib member positioned between said plates and supporting said pin.

* * * * *

UNITED STATES PATENT AND TRADEMARK OFFICE

CERTIFICATE OF CORRECTION

PATENT NO. : 5,529,205

DATED : June 25, 1996

INVENTOR(S) : Corney et al.

It is certified that error appears in the above-identified patent and that said Letters Patent is hereby corrected as shown below:

On the title page, item [73],

The Assignee should be "Rubbermaid Incorporated, Wooster, Ohio" not "Carex Inc., Newark, N.J."

Signed and Sealed this

Fourth Day of March, 1997

Bruce Lehman

*Attest:*

BRUCE LEHMAN

*Attesting Officer*

*Commissioner of Patents and Trademarks*